US009153180B2

(12) United States Patent
Ben-Chorin et al.

(10) Patent No.: US 9,153,180 B2
(45) Date of Patent: Oct. 6, 2015

(54) MULTI PRIMARY COLOR DISPLAY DEVICE AND METHOD OF DRIVING THE SAME

(75) Inventors: Moshe Ben-Chorin, Rehovot (IL); Shmuel Roth, Petkh Tikva (IL)

(73) Assignee: Samsung Display Co., Ltd. (KR)

( * ) Notice: Subject to any disclaimer, the term of this patent is extended or adjusted under 35 U.S.C. 154(b) by 250 days.

(21) Appl. No.: 13/538,945

(22) Filed: Jun. 29, 2012

(65) Prior Publication Data

US 2014/0002507 A1 Jan. 2, 2014

(51) Int. Cl.
*G09G 3/34* (2006.01)

(52) U.S. Cl.
CPC ..... *G09G 3/3413* (2013.01); *G09G 2300/0452* (2013.01); *G09G 2310/0235* (2013.01)

(58) Field of Classification Search
None
See application file for complete search history.

(56) References Cited

U.S. PATENT DOCUMENTS

| | | | | |
|---|---|---|---|---|
| 8,179,502 | B2 * | 5/2012 | Roth et al. | 349/106 |
| 2003/0214725 | A1 * | 11/2003 | Akiyama | 359/640 |
| 2004/0075763 | A1 * | 4/2004 | Tognoni | 348/441 |
| 2007/0222743 | A1 * | 9/2007 | Hirakata | 345/102 |
| 2009/0201418 | A1 * | 8/2009 | Endo et al. | 348/453 |
| 2012/0287148 | A1 * | 11/2012 | Brown Elliott | 345/593 |

* cited by examiner

*Primary Examiner* — William Boddie
*Assistant Examiner* — Bipin Gyawali
(74) *Attorney, Agent, or Firm* — Innovation Counsel LLP

(57) ABSTRACT

A display device is configured for two-field sequential operation using a multi-colored backlight and an array of selectable filters where the array includes a subpixel repeat group having more than three non-white colors. The display device includes: an array of filters for defining pixels of an image, wherein each subpixel repeat group in the array comprises at least four non-white filters and at least one white filter; a backlight module comprising an array of at least four non-white light emitting diodes; and a control unit configured to operate the array of filters and the backlight module in a two-field sequential operation scheme such that for each subpixel repeat group in the array, most of the filters are usable (for having valved light passed therethrough) in both fields, two of the filters are usable on a mutually exclusive, and at least one filter is usable only in one of the fields.

24 Claims, 3 Drawing Sheets

FIG. 4

400

| CONFIGURATION | | POWER CONSUMPTION | |
|---|---|---|---|
| SUB-PIXELS | LEDs | FULL LUMINANCE WHITE AND SATURATED COLORS | AVERAGE OVER RGBCY FULL LUMINANCE SATURATED COLORS (ASSUMING LOCAL DIMMING) |
| RGB | RGB | 1 | ~0.45 |
| RGBC+2W | RGBC | 1.6 | ~0.16 |
| RGBC+4W | RGBC | 2.1 | ~0.1 |
| RGBCY+W | RGBC | 0.81 | ~0.15 |
| RGBCY+3W | RGBC | 1.08 | ~.09 |
| RGBCY+W | RGBCY | 0.8 | ~.15 |
| RGBCY+3W | RGBCY | 1.08 | ~.09 |

FIG. 5

500

| CONFIGURATION | | RELATIVE LEDs POWER CONSUMPTION | | | | | | | | | | TOTAL |
|---|---|---|---|---|---|---|---|---|---|---|---|---|
| PANEL | LEDs | R1 | | Y | | G | | C | | B | | |
| | | F1 | F2 | F1 | F2 | F1 | F2 | F1 | F2 | F1 | F2 | |
| RGB | RGB | 26.7 | N/A | | | 41.3 | N/A | | | 32 | N/A | 100 |
| RGBCYW | RGBCW | 9.2 | 9.2 | 0 | 7.7 | 11.6 | 11.6 | 0 | 7.7 | 23.1 | 0 | 80.1 |
| RGBCYW | RGBC | 14.5 | 14.5 | 0 | 0 | 10.9 | 10.9 | 7.25 | 0 | 0 | 23.2 | 81.2 |

MULTI PRIMARY COLOR DISPLAY DEVICE AND METHOD OF DRIVING THE SAME

BACKGROUND

1. Technical Field

The present disclosure of invention relates to liquid crystal displays (LCDs) and more particularly, to LCDs employing multi primary color matrixes.

2. Related Technology

In recent years, investigation has begun into LCD displays that utilize different primary colored and/or white light sources for their subpixel repeating group (the group of three or more differently colored subpixels and optionally one or more additional white subpixels that tessellate and thereby populate the display area). The combination of different primary colored and/or white lights may be used to increase the color gamut producible by the device as well as to increase the efficiency of the LCD panel in terms of power consumption. Such multi primary color displays may use differently colored light emitting diodes (LED's, including white light emitting ones) as their backlighting light sources. Such multi primary color displays may additionally, be configured for field sequential operation, in which each image frame is subdivided into a sequential displaying of two or more fields, where each of the sequential fields energizes only a subset of the total number of subpixels used by the frame. The energizing of the subpixels with different patterns over a temporal span covered by plural fields allows for display resolution enhancing schemes such as those that rely on over-time light integration by the human visual system and/or those that rely on across-location (spatial) light integration by the human visual system.

Heretofore, it was common practice to employ at least three, if not more, fields per frame when using multi primary color displays. Some of such deployments may have included use of local backlight dimming in which the light sourcing blocks are selectively dimmed or brightened in conjunction with setting the grayscale levels of their respective light-passage controlling (light valving), liquid crystal cells. However, under current liquid crystal technologies, including those that use reduced switching rates (e.g., to reduce power consumption), a field sequential operation with at least three to four fields per frame may introduce flicker and other undesired artifacts such as color break artifacts.

Some of these drawbacks may be overcome by switching back to operating at relatively high field update rates (e.g., more than 500 fields per second), but such increase in switching rate would disadvantageously increase power consumption. Additionally, since the liquid crystal re-orientation time of liquid crystal cells is often relatively long compared to the field update time at such relatively high field update rates, undesirable color mixing may occur and this poses a major problem. It is possible to address this last point by energizing (flashing) the backlight LEDs only for short periods of time at the end of the respective field update periods, but this disadvantageously reduces the LEDs' efficiency and may require a very large number of LEDs for achieving an acceptable luminance which in turn disadvantageously increases the size and power consumption of the display. Therefore it seems that advancements for the multi primary color matrix approach may be at their end due to an irresolvable tradeoff problem that pits power consumption against production of undesirable image artifacts.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

BRIEF SUMMARY

In accordance with one aspect of the present disclosure of invention, there is provided a display device configured for two-field sequential operation using a backlight matrix and a corresponding array of filtered liquid crystal cells (not necessarily matched on a one-for-one basis with the colors of light sources, but) where the arrays of filtered liquid crystal cells each have more than three non-white different colors (e.g., Red, Green, Blue and Cyan) and can optionally also provide a white or clear cell. By using a carefully selected two-field sequential operation scheme, the color gamut of the display may be increased, the power consumption of the display may be reduced, when compared with conventional RGB displays or conventional, three- or more fielded other multi primary displays, and yet the artifacts may be avoided or at least substantially reduced.

A display device according to an exemplary embodiment includes a backlighting panel, a front panel having a plurality of Filtered Optical Valve Units (FOVU's) having respectively differently colored filters, where the FOVU's are grouped into subpixel repeat groups that populate a display area in a tessellating manner. In one embodiment, each subpixel repeat group (SPRG) in the array comprises at least four non-white filters and at least one white filter. The backlighting module which provides light to one or more corresponding SPRG's may comprises an array of at least four non-white LEDs, for example red, blue, green and cyan (R*, B*, G*, C*). The display device further comprises a control unit that is configured to selectively operate the array of Filtered Optical Valve Units (FOVU's) differently in each of two respective fields (F1 and F2) of a two-fields frame and the control unit is also configured to selectively operate the array of LED's in the backlight module differently in each respective field of the two-field sequential frame such that for each SPRG (subpixel repeat group), most of the FOVU's are operable in both fields (F1 and F2), operability of two of the FOVU's is mutually exclusive over the two fields (F1 and F2), and at least one FOVU is dedicated to be operational only in one of the fields.

These, and additional and/or other aspects and/or advantages of the exemplary embodiments are set forth below in the detailed description which follows.

BRIEF DESCRIPTION OF THE DRAWINGS

For a better understanding of exemplary embodiments and to show how the same may be carried into effect, reference will now be made, purely by way of example, to the accompanying drawings in which like numerals designate corresponding elements or sections throughout.

In the accompanying drawings:

FIG. 4 (Table 1) is a comparative table illustrating properties of exemplary configurations according to some embodiments of the present disclosure; and FIG. 5 (Table 2) is another comparative table illustrating further properties of exemplary configurations according to some embodiments of the present disclosure.

DETAILED DESCRIPTION

Figure 1A:
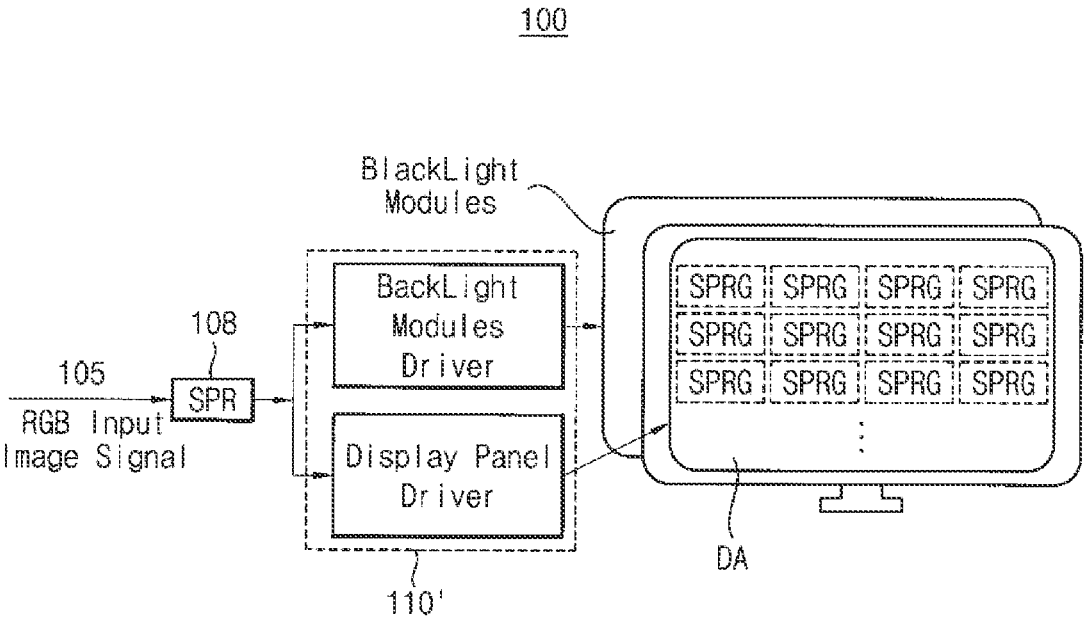
FIGS. 1A and 1B provide high level schematic block diagrams illustrating an exemplary display system in accordance with the present disclosure of invention.

FIG. 1A is a high level schematic block diagram illustrating a display device 100 configured in accordance with the present teachings. The exemplary display device 100 includes: a subpixel rendering unit (SPR) 108 that is configured to receive a three-primary colors (e.g., RGB) encoded image representing signal 105 and to produce one or more re-mapped, image representing signals for driving a more-multi-colored display panel whose subpixels include more than just the three-primary colors and whose subpixels are laid out in a geometric pattern other than the one expected by the input image representing signal 105.

The display device 100 may include a multi-colored backlighting panel as well as the multi-colored, subpixels containing front panel. The display area (DA) of the multi-colored, front panel is tessellated by a plurality of so-called, subpixel repeat groups (SPRG's) each having a repeated same pattern of multi-colored (and optionally white) subpixels. GrayScale control signals (112) are applied to the front panel for individually controlling the respective subpixels of each SPRG while BackLighting control signals (111) are applied to the rear backlighting panel for controlling the respective multi-colored light sources included therein. Although not specifically shown, the backlighting panel may be subdivided into a plurality of local dimming blocks where each local dimming block supplies multi-colored light to a respective plurality of SPRG's in the front panel.

Figure 1B:
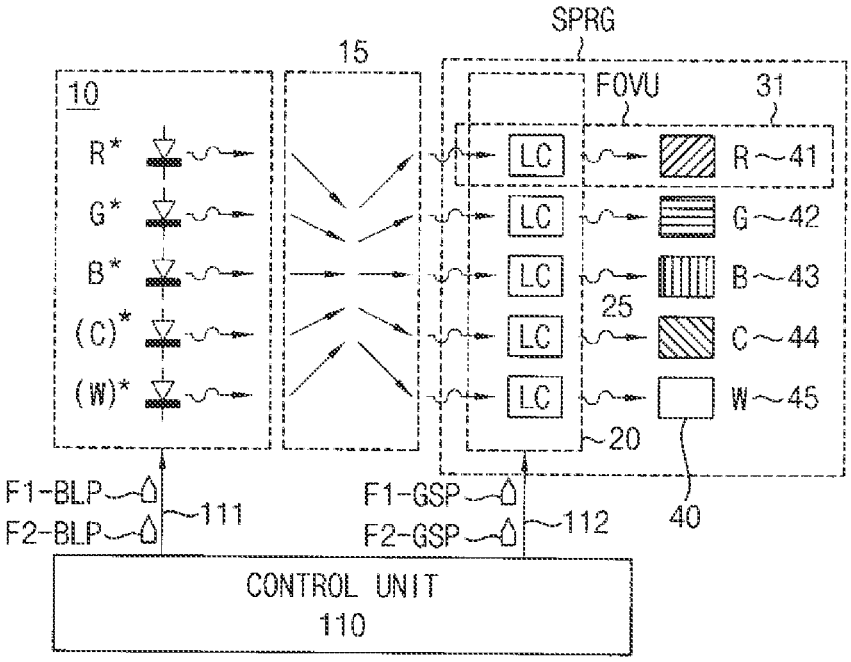

Referring to FIG. 1B, each SPRG (subpixel repeat group) is subdivided into a plurality of Filtered Optical Valve Units (FOVU's) where for example, FOVU 31 is a Red light controlling such Filtered Optical Valve Unit that includes a red light-only passing filter 41 and an individually controllable and corresponding light shuttering valve. The light shuttering valve may be in the form of a liquid crystal cell (LC).

In the illustrated example, a second of the FOVU's has a green light-only passing filter 42 and a respective liquid crystal cell (LC). A third of the FOVU's has a blue light-only passing filter 43 and a respective, individually controllable liquid crystal cell (LC). A fourth of the FOVU's has a cyan light-passing filter 44 and a respective, individually controllable liquid crystal cell. The cyan light-passing filter 44 may pass cyan light, or blue light or green light. The exemplary SPRG also has a fifth FOVU whose corresponding filter 45 is a white light passing (or clear) optical transmitter. The white light passing (or clear) optical transmitter 45 can pass white light and/or any one or more of the red, blue, green, and cyan wavelengths.

The illustrated array of wavelength selective (or generally non-selective in the case of white) light-passing filters 40 which are associated with the respective subpixels of a screen-tessellating, repeat group (SPRG) can be selectively energized to form an image in the display area (DA) of the display device 100. In one embodiment, each repeat group (SPRG) comprises at least four non-white light filters 41-44 and at least one white light-passing filter 45 and corresponding light passing control valves (e.g., liquid crystal cells LC) 20.

In one embodiment, each of the FOVU's (e.g., 41-45) of each subpixel repeat group (SPRG) can receive sourced lights from all of the multi-colored light sources 10 (e.g., R*, G*, B*, (C*), (W*)) of a corresponding backlighting module. The asterisk after each light source color designation X* may be read as "star" to remind the reader that the asterisk-starred light source color designation X* is that of a light source (where X=R or G or B, etc.). Some of the light sources are optional and such is indicated with parenthesis (e.g., (C*) and (W*)).

As mentioned above, one backlighting module 10 can service several SPRG's, particularly where localized backlight dimming is employed. Alternatively, one backlighting module 10 can service all the subpixel repeat groups (SPRG's) of the display area (DA). The coupling of the lights from the light sources to all the FOVU's (e.g., 41-45) of a corresponding SPRG is represented by the symbol for light coupling member 15. This light coupling member 15 may include a light guide plate (LPG) and/or one or more light diffusing and light redistributing optical sheets (not shown).

The corresponding light sources 10 (e.g., R*, G*, B*, C*, W*) of the display device 100 may form a repeated backlighting module and each such backlight module 10 may include an array of at least four individually energizable non-white light emitting diodes (LEDs) and also an individually energizable white light source which may be a white light emitting LED or a non-segregated combination of primary colors (e.g., R, G, B). Between the backlight module 10 and the array of filters 40, there is interposed the array 20 of electronically controlled liquid crystal cells. The respective intensities of light rays 25 which pass from the respective liquid crystal cells 20 to the rears of their respective color filters 40 are controlled by GrayScale (GS) control signals applied to the respective liquid crystal (LC) cells 20. The number of individually controlled liquid crystal cells per repeat group (and associated color filters 40) may be greater than the number of individually controlled light sources (e.g., LED's) per backlighting module 10.

Since the light sources of the corresponding backlight module 10 may be individually energized or not, the backlighting light supplied to the liquid crystal cells 20 need not always be of a white light type. It can for example, be relatively "blueish" during display of one field (F1) of a multi-field image frame and relatively "yellowish" during display of a second field (F2) of the multi-field image frame. In one embodiment, the display device 100 includes a control unit 110 configured to selectively operate the filtered liquid crystal cells 20 on an individualized basis so as to define different GrayScale Patterns (GSP's) in respective first and second field display periods and configured to selectively operate the multi-colored light sources of the backlight module 10 so as to define different BackLighting Patterns (BLP's) in respective first and second field display periods, where the first and second field display periods (F1 and F2) correspond to a pre-specified two-field sequential operation scheme. Accordingly, each image frame generated by the display device 100 may consist of a successive energizing of two fields, each having at least two respectively energizable primary colors (e.g., Red and Green (which can combine to be "yellowish") in one field and Blue with Cyan in the other). Using a process known as subpixel rendering (SPR), each pixel of an input color image representing data signal 105 is mapped as contributing weighted energies to respective ones of several neighboring liquid crystal cells on the LC array 20 in accordance with the spatial position of the input pixel and its scaled mapping onto the corresponding subpixel areas of the display device 100. These liquid crystal cells 20 together with their corresponding filters 40 and/or correspondingly then-energized backlighting light sources 10 define the individually generated and subpixel controlled lights of the subpixel-populated display area of the display device 100. The field sequential operation of the display device 100 implies that different combinations of the colored or white light producing subpixels are respectively energized in each field (F1, F2) of the frame, so that the light patterns coming from the subpixels of the different fields are different. In one embodiment, this forming of different light patterns may include different patterns of energized backlight light sources 10 (e.g., R and G in one field and B plus C in the other field with optional energizing of white in both). The colors of the input image pixels may thus be reproduced with aid of temporal and/or spatial dithering and with aid of the temporal and spatial integration performed by the human visual system. Such temporal and/or spatial dithering may be used to increase the perceived resolutions of grayscales and color point placements produced by the display on a per frame basis.

According to at least some embodiments of the present disclosure, the prespecified two-field (F1, F2) sequential operation scheme requires satisfaction of the following conditions, for each repeating group of subpixels: (i) at least two differently colored subpixels are operable in both fields (their operability overlaps), (ii) at least two of the differently colored subpixels are operable on a mutually exclusive basis over the two fields (their operability does not overlap), and (iii) at least one of the differently colored subpixels (e.g., Blue, see FIG. 5) is dedicated to operating only in a respective one (e.g., second) of the two fields, F1 and F2.

More specifically, and referring just briefly now to middle row of FIG. 5 (Table 2) it may be seen that each of the differently colored subpixels RGBCY (but not W) has operability in both fields (F1 and F2) or operability in only one of the fields (F1 or F2). Yet more specifically, each of R and G is operable in both fields, each of Y and C is operable only in the second field (F2) and B is dedicated to being operable only in the first field (F1) thus being mutually exclusive or non-overlapping relative to each of the Y and C colored subpixels. FIG. 5 will be further detailed later below.

Several configurations and sets of values may provide significantly better performance both in terms of extending the color gamut and in terms of reducing the power consumption (e.g., by approximately 20% as shown in FIG. 5) of the backlighting LEDs. Specifically, the configurations of the two-field sequential operation may use backlighting LEDs of the red color, green color, blue color, cyan color, and possibly yellow color. The corresponding array of filtered liquid crystal cells (individually controlled subpixels) includes red color, blue color, green color, cyan color, white (clear) and possibly yellow color and/or magenta color. In other words, and to repeat a concept already explained above, the number of individually controlled and differently colored subpixels (or non-colored if white) may be greater than the number of backlighting light sources of the respective backlighting module 10. More specifically, and merely as an example, note that although there is no W* LED in the bottom row of FIG. 5 (TABLE 2), a white light may be generate in F2 by simultaneously energizing the R*, G* and B* LEDs and having their combined light rays pass through the white (or clear) filter (as well as through the corresponding red, blue, green, cyan and yellow filters. Similarly, although there is no Y LED in the bottom row of FIG. 5 (TABLE 2), a yellow light may be generated in F1 by simultaneously energizing the R* and G* but not the B* LEDs and having their combined light rays pass through a white (or clear) and/or yellow filter.

Temporal separation of closely-hued colors may be achieved by using the two-field sequential operation scheme. For example, in one field the cyan color is being generated and in another field the blue one is being generated. The realized improvement in efficiency is due to the use of the white subpixels (pass all) and by working with yet other filters having spectrums wider than the corresponding LEDs that shine light towards them. For example, by providing a yellow filter to be overlappingly driven by the R* and G* LED's, not only can green be individually passed therethrough but also red. Thus one filtered area (e.g., Y) of the subpixels repeat group can generate yellow during a first field and it can generate one of red and green (or neither) during the second field. Similarly, one Cyan colored filter can generate cyan during a first field and it can generate one of blue and green (or neither) during the second field.

It may be seen from further analysis that the display device 100 can exhibit a simplified architecture that uses specific configurations of fields and a way to use them as will be presented in detail below. Thus, display device 100 achieves better results than more complicated multiple field architectures that utilize at least three fields per frame as was heretofore thought to be necessary in the pertinent art.

In accordance with some exemplary embodiments, the two-field sequential operation scheme may be configured such that both fields (F1 and F2) each include partial or full opening of at least one white FOVU (Filtered Optical Valve Unit). Additionally and alternatively, the two mutually exclusively operated (partially or fully opened) Filtered Optical Valve Units are a blue color FOVU and a cyan color FOVU such that the blue color filter is used to pass valved light only in a first field and the cyan color filter is used to pass valved light only in a second field. Additionally and alternatively, in each field (F1 and F2) a red color FOVU and a green color FOVU are both operable (e.g., to be partially or fully opened) to selectively pass light.

in accordance with some exemplary embodiments, control unit 110 may be further configured to control the LEDs of backlight module 10 according to the two-field sequential operation scheme such that the F1 backlighting energizing pattern (BLP) of corresponding first field F1 is different than the F2 backlighting energizing pattern (BLP) of corresponding second field F2 per the indications shown adjacent to line 111 of FIG. 1B. Optionally, but not mandatorily, each color LED is operated only in a field in which its same colored FOVU operates. Thus, the Red* LED may be operated in both fields because the corresponding Red FOVU (31) is also operable in both fields (F1 and F2), On the other hand, the Blue* LED is allowed to be operated in the same one field in which the blue FOVU (Filtered Optical Valve Unit) is exclusively operable. Optionally, but not mandatorily, the LEDs of backlight module 10 are selected such that their respective spectrums are each narrower than the light-passing spectrum of their same color designated filters of array of filters 40, or alternatively, the vise versa approach is taken where the respective filters 40 are each selected to have a respective light-passing spectrum (bandwidth) that is wider than the corresponding output spectrum of the corresponding, same colored light source in order to assure that light output efficiency does not suffer due to the respective filters absorbing part of the wavelengths output of their respective and same colored light sources.

In accordance with some exemplary embodiments, control unit 110 is further configured to control the backlight module and the array of filters such that a respective total luminance level associated with each field (F1 and F2) is substantially equal with that of the other. This is carried order to avoid or reduce perception of flicker and/or color breakup.

Figure 2:
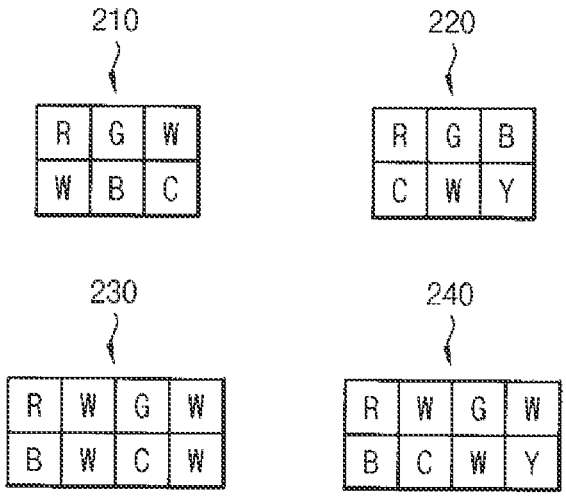
FIG. 2 is a schematic diagram showing four exemplary layout configurations for the screen tessellating array of differently-colored subpixels (the subpixel repeating group consisting of respective filtered liquid crystal cells)

FIG. 2 is a schematic diagram showing four exemplary configurations (e.g., geometric layouts) that may be used for the plural FOVU's (Filtered Optical Valve Unit) of respective subpixel repeat groups (SPRG's). It is to be understood that while for purpose of illustration only, the several (e.g., 4) configurations are shown, other configurations are contemplated. In one configuration 210, one red (R), one green (G), two white (W), one blue (B) and one cyan (C) of filters are used as shown for a rectangular 2-by-3 repeat group. In another configuration 230, one red (R), one green (G), four white (W), one blue (B) and one cyan (C) of filters are used as shown for a rectangular 2-by-4 repeat group. In yet another configuration 220, one red (R), one green (G), one white (W), one blue (B), one cyan (C), and one yellow (Y) of filters are used as shown for a rectangular 2-by-3 repeat group. In yet another configuration 240, one red, one green, three white, one blue, one cyan, and one yellow of filters are used as shown for a rectangular 2-by-4 repeat group. Any one of configurations 210-240 may be used in combination with a backlight module 10 having a red (R*), a green (G*), a blue (B*), and a cyan (C*) set of LEDs (and optionally a white (W*) one too). Configurations 230 and 240 may also be used with a backlight module having a red, green, blue, cyan, and yellow set of LEDs (and possibly white too).

Figure 3:
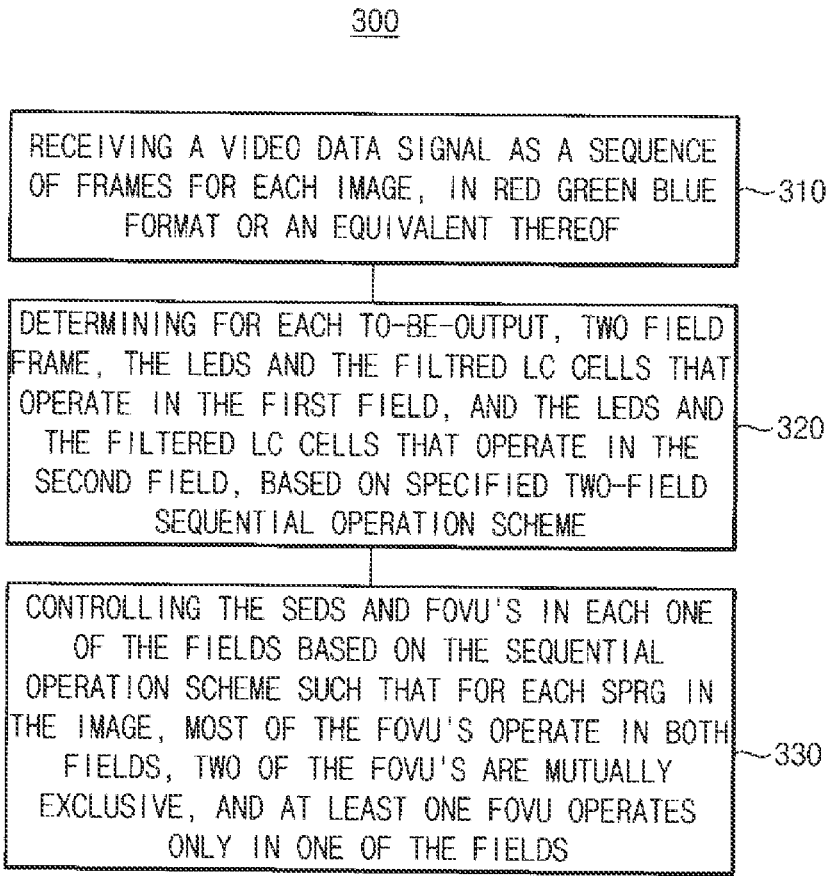
FIG. 3 is a high level flowchart illustrating a method of deploying a two-sequential-fields frame in accordance with the present disclosure.

FIG. 3 is a high level flowchart illustrating a method 300 of controlling a display device according to a pre-specified two-field sequential operation scheme according to the present teachings. Method 300 may be carried out using the architecture of the display device 100 shown in FIGS. 1A-1B or in any other comparable architecture that includes: (i) an appropriate backlight module 10 having an array of at least four non-white light sources (X1*, X2*, X3*, X4*, etc., Xn represents a respective n-th color) and an array of correspondingly colored FOVU's (Filtered Optical Valve Units) as appropriate for defining the desired subpixel repeat group (SPRG) that tessellates the display area (DA) of a respective display panel, wherein each SPRG comprises at least four non-white FOVU's (Filtered Optical Valve Units) and at least one white FOVU. However, it is noted that method 300 might be implemented with architectures other than that of display device 100.

Method 300 is a machine-implemented process that starts off in step 310 with the receiving a supplied video data signal (e.g., 105 of FIG. 1A) that represents a sequence of frames for each image, in a tri-primary-colors format, for example a red green blue format. The method then goes on to step 320 wherein it is automatically determined for each two-field frame, which of the colored light sources 10 and which of the FOVU's (20/40) will be operable during the first field (F1), and which of the colored light sources 10 and which of the FOVU's (20/40) will be operable during the second field (F2), based on which two-field sequential operation scheme is specified as being the operational one. Then, in step 330 the method goes on with the stage of automatically controlling the FOVU's (20/40) during each one of the fields (F1 and F2) based on the specified sequential operation scheme. The automated controlling of the FOVU's (20/40) is carried out such that for each subpixel repeat group in the display area tessellating array, most of its FOVU's (20/40) are operational in both fields (F1 and F2), two of the FOVU's are operational on a mutually exclusive basis in the respective first and second fields (F1 and F2), and at least one FOVU (e.g., the Blue one) is dedicated to being operational only in one of the fields. These stages of 320 and 330 are then repeated for every new frame received in step 310 by the display device.

Table 1 (shown in FIG. 4) is a comparative table 400 illustrating properties in terms of power consumption of exemplary configurations according to some embodiments in accordance with the present disclosure of invention. The following configurations were tried and tested. It is understood that other configurations may be produced similarly by adhering to the here provided guidelines.

According to one configuration the backlight module comprises red color LEDs, blue color LEDs, green color LEDs, and cyan color LEDS, and wherein each pixel in the Filtered Optical Valve Units array includes a selection of selectively operable filters including: a red color filter, a green color filter, a blue color filter, a cyan color filter, and two white filters (denoted as the subpixels in the first column of Table 1, where the presently-described embodiment is reflected in the second row as RGBC+2W).

According to another configuration, the backlight module comprises red color LEDs, blue color LEDs, green color LEDs, and cyan color LEDS, wherein each SPRG includes a layout of selectively-activatable filters including: a red color filter, a green color filter, a blue color filter, a cyan color filter, and four white filters (RGBC+4W).

According to yet another configuration, the backlight module comprises red color LEDs, blue color LEDs, green color LEDs, and cyan color LEDS, wherein each pixel (SPRG) in the front panel array includes selectively operable filters including: a red color filter, a green color filter, a blue color filter, a cyan color filter, a yellow color filter and a white filter (RGBCY+W).

According to yet another configuration, the backlight module comprises red color LEDs, blue color LEDs, green color LEDs, and cyan color LEDS, wherein each pixel in the front panel array includes a selectable set of filters including: a red color filter, a green color filter, a blue color filter, a cyan color filter, a yellow color filter and three white filters (RGBCY+3W).

According to yet another configuration, wherein the backlight module comprises red color LEDs, blue color LEDs, green color LEDs, cyan color LEDS, and yellow color LEDs, wherein each pixel in the front panel array includes a selectable set of filters including: a red color filter, a green color filter, a blue color filter, a cyan color filter, a yellow color filter and a white filter (RGBCY+W).

According to yet another configuration, the backlight module comprises red color LEDs, blue color LEDs, green color LEDs, cyan color LEDS, and yellow color LEDs, wherein each pixel in the front panel array includes a selectable set of filters including: a red color filter, a green color filter, a blue color filter, a cyan color filter, a yellow color filter and three white filters (RGBCY+3W).

Referring to the comparative table 400 it may be shown that the white point xy chromaticity coordinates for all the illustrated configurations can be adjusted to approximately (0.280, 0.290), by appropriately changing the ratio of luminances of differently colored LEDs in the backlight. The first column under the power consumption header provides the normalized power (with respect to RGB color matrix with RGB LED backlight being a 1.00) under the worst case scenario in which an examined region in the display requires all saturated colors and a white color to appear. The second column gives estimates on the normalized consumed power, when each region presents only one of the primary colors.

Table 2 (shown in FIG. 5) is another comparative table illustrating further properties of exemplary configurations according to some embodiments of the present disclosure of invention. Specifically, comparative table 500 shows relative LEDs power consumption for the two fields (F1 and F2) of two illustrated configurations (bottom two rows) as compared in view of a currently available standard RGB (third from bottom row).

As discussed above, some embodiments require a backlight having more than three colors and an array of color filters also having more than three non-white colors (and white filters as well). Thus, these constraints yield three equations and more than three variables. However, the data is still provided in a threes color format (RGB or other). This situation leads to a very large number of feasible field configurations.

While implementing the embodiments of the present disclosure, the present inventors discovered a method of optimizing the selection of colors for the filters in each field (F1 and F2) as well as the corresponding constraints on the backlight LED's. The results are presented by the here disclosed Table 2 (shown in FIG. 5).

The optimization selection is performed using the following steps: (1) checking the front panel and the backlight and determining the hardware properties (properties of the LEDs in the backlight and the filters in the color matrix—filter array); (2) defining a color by the filters it can pass through (e.g., each of Blue and Green sourced lights can pass through a wide-band Cyan filter) and presence of such passable lights in each of the two fields (F1 and F2). For example, red light is defined by: existing in both fields and passes thru red filter in both fields. Another example, the blue light passes via blue filter but only in first field, and the green light passes via green filter but in the second field. The optimization then goes on to a step of (3) defining a color system in which: (a) certain LEDs with turn on only in the first field and others only in the second field, to yield a combination of LEDs in both fields; (4) the combination of LEDs in the first field are passing via filters—defining primaries. For example, in case there are four filters of color (putting the white filter aside) and a combination of LEDs R*, Y*, G*, C*, B* when the LEDs are passing the filters yields a certain result. Similarly, the same procedure can be carried out for the second field.

Thus, defining a producible five primaries in the first field and a producible five primaries in the second field, then, checking the primaries, if there are two primaries that are very close to each other, meaning red in both field that passed via a red filter may be consolidated into one primary. In other words, a consolidation of close primaries is carried out in order to narrow the number of solutions. This step is not essential but convenient in the optimized implementation.

It is noted that known other third-party optimization solutions may be carried out in order to break down video input data into a plurality of primaries. An example is an optimization problem that may be solved by brightness and chromaticity of an entered value, for determining which combination of primaries yields a certain chromaticity with maximum luminance/brightness. If the required luminance is lower than the maximal luminance then the combination is being calibrated in reference to the brightness. If the brightness is larger than the maximal to be produced then it is out of the gamut of the display so back-mapping (e.g., clipping) into the gamut is required.

In case there is no local dimming on the panel and the backlight is even and consists of temporal operation over only two fields, the optimization process includes the following steps: (a) defining the primaries, being the LEDs combination that passes via each one of the filters (excluding the white); and splitting the signal received for each signal into the fields taking into account consolidation of primaries in case it was performed in the first step.

As will be appreciated by those skilled in the art in view of the novel teachings provided herein, aspects of the exemplary embodiments may be otherwise embodied as a system, method or physical computer program product. Accordingly, aspects of the exemplary embodiment may take the form of an entirely hardware embodiment, an entirely physically-implemented software embodiment (including firmware, resident software, micro-code, etc.) or an embodiment combining such software and hardware aspects that may all generally be referred to herein as a "circuit," "module" or "system." Furthermore, aspects of the exemplary embodiment may take the form of a computer program product embodied in one or more computer readable medium(s) having appropriate computer readable program code embodied thereon for controlling a correspondingly instructable and code executing machine.

In the above description, each embodiment is an example or an implementation of the here disclosed inventive concepts. The various appearances of "one embodiment," "an embodiment" or "some embodiments" do not necessarily all refer to the same embodiments.

Although various features of the present disclosure of invention may be described in the context of a single embodiment, the features may also be provided separately or in any suitable combination. Conversely, although the various teachings may be have been described herein in the context of separate embodiments for clarity, the teachings may be combined also to be implemented in a single embodiment.

Reference in the specification to "some embodiments", "an embodiment", "one embodiment" or "other embodiments" means that a particular feature, structure, or characteristic described in connection with the respective embodiment(s) is included in at least some embodiments, but not necessarily all embodiments.

It is to be understood that the phraseology and terminology employed herein is not to be construed as limiting and are for descriptive purpose only.

The principles and uses of the teachings of the exemplary embodiment may be better understood with reference to the accompanying description, figures and examples.

It is to be understood that the details set forth herein do not construe a limitation to an application of the invention.

Furthermore, it is to be understood that the invention is non-abstract and can be carried out or practiced in various physically real ways and that the present teachings can be implemented in embodiments other than the exemplary ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element. It is to be understood that where the claims or specification refer to "a" or "an" element, such reference is not be construed that there is only one of that element.

Methods of the exemplary embodiment may be implemented by non-abstractly performing or completing manually, automatically, or a combination thereof, selected steps or tasks. The descriptions, examples, methods and materials presented in the claims and the specification are not to be construed as limiting but rather as illustrative only. Meanings of technical and scientific terms used herein are to be commonly understood as by one of ordinary skill in the art to which the present teachings belongs unless otherwise defined.

While the invention has been described with respect to a limited number of embodiments, these should not be construed as limitations on the scope of the claimed invention, but rather as exemplifications of some of the preferred embodiments. Other possible variations, modifications, and applications are also within the scope of the teachings.

What is claimed is:

1. A display device comprising a backlighting panel and a light-valving panel configured for producing images, wherein:

the backlighting panel is operatively coupled to the light-valving panel such that lights from different light sources included in the backlighting panel can be simultaneously and mixedly supplied to respective ones of repeat group areas of the light-valving panel, and wherein the light-valving panel includes:

a respective array of individually controlled light-valving cells;

a respective array of differently colored or uncolored filters respectively overlapping the respective and individually controlled light-valving cells, said differently colored ones of the filters comprising at least four differently colored non-white filters and said uncolored filters comprising at least one white or clear filter, each combination of filter and corresponding light-valving cell defining a respective Filtered Optical Valve Unit (FOVU) through which can pass a correspondingly filtered portion of the backlighting supplied thereto from the backlighting panel, with plural ones of said FOVU's being respectively grouped into each of said repeat group areas of the light-valving panel, each repeat group area defining a pixel and having a repeating same color pattern of said FOVU's; and wherein the backlighting panel includes:

a respective backlight module comprising an array of said different light sources where the array includes at least four non-white and differently colored as well as individually controlled light sources; and wherein the display device further comprises:

a control unit operatively coupled to, and configured to selectively operate the respective array of light-valving cells and the respective backlighting module in accordance with a two-field sequential operation scheme such that:

a first subset of at least two of the differently colored FOVU's of each corresponding repeat group area are operable in both of the two fields, and a second subset of at least two others of the differently colored FOVU's of each corresponding repeat group area are only operable on a mutually exclusive basis over the respective two fields.

2. The display device according to claim 1, wherein a FOVU corresponding to the at least one white filter is operable by the control unit in both of the two fields.

3. The display device according to claim 1, wherein the second subset of FOVU's comprises a blue color filter and a cyan color filter such that the FOVU corresponding to the blue color filter is operable by the control unit only in the first field and the FOVU corresponding to the cyan color filter is operable by the control unit only in the second field.

4. The display device according to claim 1, wherein the at least four differently colored non-white filters include a red color filter and a green color filter and wherein in each field a red color FOVU and a green color FOVU are both operable by the control unit.

5. The display device according to claim 1, wherein the control unit is further configured to control the light sources of the backlight module consistent with the two-field sequential operation scheme.

6. The display device according to claim 1, wherein the control unit is further configured to control the backlight module and the FOVU's such that a luminance level associated with each field is substantially equal to that of the other.

7. The display device according to claim 1, wherein the backlight module comprises red color light sources, blue color light sources, green color light sources, and cyan color light sources, and wherein each of subpixel repeat groups (SPRG's) that populate the respective repeat group areas of the front panel includes a selectable set of filters including: a red color filter, a green color filter, a blue color filter, a cyan color filter, and two white filters.

8. The display device according to claim 1, wherein the backlight module comprises red color LEDs, blue color LEDs, green color LEDs, and cyan color LEDS, and wherein each of subpixel repeat groups (SPRG's) that populate the respective repeat group areas of the front panel includes a selectable set of filters including: a red color filter, a green color filter, a blue color filter, a cyan color filter, and four white filters.

9. The display device according to claim 1, wherein the backlight module comprises red color LEDs, blue color LEDs, green color LEDs, and cyan color LEDS, and wherein each of subpixel repeat groups (SPRG's) that populate the respective repeat group areas of the front panel includes a selectable set of filters including: a red color filter, a green color filter, a blue color filter, a cyan color filter, a yellow color filter and a white filter.

10. The display device according to claim 1, wherein the backlight module comprises red color LEDs, blue color LEDs, green color LEDs, and cyan color LEDS, and wherein each of subpixel repeat groups (SPRG's) that populate the respective repeat group areas of the front panel includes a selectable set of filters including: a red color filter, a green color filter, a blue color filter, a cyan color filter, and two white filters.

11. The display device according to claim 1, wherein the backlight module comprises red color LEDs, blue color LEDs, green color LEDs, cyan color LEDS, and yellow color LEDs, and wherein each of subpixel repeat groups (SPRG's) that populate the respective repeat group areas of the front panel includes a selectable set of filters including: a red color filter, a green color filter, a blue color filter, a cyan color filter, a yellow color filter and a white filter.

12. The display device according to claim 1, wherein the backlight module comprises red color LEDs, blue color LEDs, green color LEDs, cyan color LEDS, and yellow color LEDs, and wherein each of subpixel repeat groups (SPRG's) that populate the respective repeat group areas of the front panel includes a selectable set of filters including: a red color filter, a green color filter, a blue color filter, a cyan color filter, and two white filters.

13. A method of operating a display device that comprises: (i) a backlight module having an array of at least four non-white light emitting diodes (LEDs), (ii) an array of liquid crystal cells, and (iii) an array of filters each covering a respective one of the liquid crystal cells, the combination defining pixels of display device for displaying an image, wherein each pixel in the array may be produced by use of at least four non-white filters and at least one white filter, according to a specified two-field sequential operation scheme, each combination of filter and corresponding liquid crystal cell defining a respective Filtered Optical Valve Unit (FOVU), with plural ones of said FOVU's being respectively grouped into repeat group areas, each repeat group area defining one of the pixels and having a repeating same color pattern of said FOVU's, the method comprising:

receiving a video data signal as a sequence of frames, in a three non-white color format;

determining for each frame, the LEDs and liquid crystal cells associated with filters that are to operate in a first field, and the LEDs and liquid crystal cells associated with filters that are to operate in a second field, based on specified two-field sequential operation scheme; and controlling the liquid crystal cells associated with filters in each one of the fields based on the sequential operation scheme such that for each repeat group area, most of the filters are operable in both fields, two of the filters are mutually exclusive over the two fields, and at least one filter is operable only in one of the fields.

14. The method according to claim 13, wherein both fields can include at least one white filter operated in both of the fields.

15. The method according to claim 13, wherein the two mutually exclusive filters are a blue color filter and a cyan color filter such that the blue color filter is operated only in a first field and the cyan color filter is only operated in a second field.

16. The method according to claim 13, wherein in each one of the fields, a red color filter and a green color filter are both operated.

17. The method according to claim 13, wherein the controlling further comprise controlling the LEDs of the backlight module consistent with the specified two-field sequential operation scheme.

18. The method according to claim 13, wherein the controlling is carried out such that a luminance level associated with each one of the fields is substantially equal to that of the other.

19. The method according to claim 13, wherein the backlight module comprises red color LEDs, blue color LEDs, green color LEDs, and cyan color LEDS, and wherein each pixel in the array includes a selectable set of filters including: a red color filter, a green color filter, a blue color filter, a cyan color filter, and two white filters.

20. The method according to claim 13, wherein the backlight module comprises red color LEDs, blue color LEDs, green color LEDs, and cyan color LEDS, and wherein each pixel in the array includes a selectable set of filters including: a red color filter, a green color filter, a blue color filter, a cyan color filter, and four white filters.

21. The method according to claim 13, wherein the backlight module comprises red color LEDs, blue color LEDs, green color LEDs, and cyan color LEDS, and wherein each pixel in the array includes a selectable set of filters including: a red color filter, a green color filter, a blue color filter, a cyan color filter, a yellow color filter and a white filter.

22. The method according to claim 13, wherein the backlight module comprises red color LEDs, blue color LEDs, green color LEDs, and cyan color LEDS, and wherein each pixel in the array includes a selectable set of filters including: a red color filter, a green color filter, a blue color filter, a cyan color filter, and two white filters.

23. The display device according to claim 1, wherein the backlight module comprises red color LEDs, blue color LEDs, green color LEDs, cyan color LEDS, and yellow color LEDs, and wherein each pixel in the array includes a selectable set of filters including: a red color filter, a green color filter, a blue color filter, a cyan color filter, a yellow color filter and a white filter.

24. The display device according to claim 1, wherein the backlight module comprises red color LEDs, blue color LEDs, green color LEDs, cyan color LEDS, and yellow color LEDs, and wherein each pixel in the array includes a selectable set of filters including: a red color filter, a green color filter, a blue color filter, a cyan color filter, and two white filters.

* * * * *